US010100841B2

(12) United States Patent
Rodriguez Erdmenger et al.

(10) Patent No.: US 10,100,841 B2
(45) Date of Patent: Oct. 16, 2018

(54) CENTRIFUGAL COMPRESSOR AND SYSTEM

(71) Applicant: General Electric Company, Schenectady, NY (US)

(72) Inventors: Rodrigo Rodriguez Erdmenger, Garching b. Munchen (DE); Vittorio Michelassi, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 393 days.

(21) Appl. No.: 15/075,339

(22) Filed: Mar. 21, 2016

(65) Prior Publication Data

US 2017/0268528 A1 Sep. 21, 2017

(51) Int. Cl.

| | |
|---|---|
| ***F04D 29/30*** | (2006.01) |
| ***F04D 29/28*** | (2006.01) |
| ***F04D 29/42*** | (2006.01) |

(52) U.S. Cl.

CPC ..... *F04D 29/30* (2013.01); *F04D 29/284* (2013.01); *F04D 29/4206* (2013.01)

(58) Field of Classification Search

CPC ..... F04D 29/30; F04D 29/284; F04D 29/285; F04D 29/4206

See application file for complete search history.

(56) References Cited

U.S. PATENT DOCUMENTS 1,622,930 A * 3/1927 Von Karman ..... F01D 5/048 415/140
3,627,447 A * 12/1971 Okapuu ..... F01D 5/045 415/143

(Continued)

FOREIGN PATENT DOCUMENTS

CN 10157609 A 11/2009

OTHER PUBLICATIONS

Erdmenger et al.; Influence of Tandem Inducers on the Performance of high Pressure Ratio Centrifugal Compressors; ASME Turbo Expo, Turbine Technical Conference and Exposition; Jun. 2015; vol. 2C, 13 Pages.

(Continued)

*Primary Examiner* — Igor Kershteyn
(74) *Attorney, Agent, or Firm* — GE Global Patent Operation; Pabitra Chakrabarti

(57) ABSTRACT

Centrifugal compressor having flow-control blades in which each of the flow-control blades has a pressure side and an opposite suction side. Each of the flow-control blades includes a main section and an inducer section that project away from an impeller surface. The inducer section is positioned upstream from the main section. The inducer section includes a trailing edge and the main section includes a leading edge that is spaced apart from the trailing edge. The inducer sections are aligned with the respective main sections as the inducer and main sections project from the impeller surface to a designated point above the impeller surface. Each of the trailing edges of the inducer sections and the respective leading edge of the main section form a bleed gap therebetween after the designated point. The bleed gap is configured to permit fluid to flow therethrough from the pressure side to the suction side.

20 Claims, 10 Drawing Sheets

(56) References Cited

U.S. PATENT DOCUMENTS

| | | | | |
|---|---|---|---|---|
| 3,958,905 | A * | 5/1976 | Wood | F01D 5/045 415/143 |
| 4,183,719 | A * | 1/1980 | Bozung | F01D 5/045 415/143 |
| 4,502,837 | A | 3/1985 | Blair et al. | |
| 4,615,659 | A * | 10/1986 | Sidransky | F04D 29/30 416/183 |
| 5,213,473 | A * | 5/1993 | Fiala | F01D 5/048 416/183 |
| 7,156,612 | B2 * | 1/2007 | Warikoo | F01D 5/026 415/143 |
| 7,563,074 | B2 | 7/2009 | Xu | |
| 7,870,731 | B2 * | 1/2011 | Fledersbacher | F01D 5/022 415/119 |
| 8,550,775 | B2 | 10/2013 | Chen | |
| 8,920,128 | B2 * | 12/2014 | Matwey | F01D 5/046 416/231 R |
| 2004/0009060 | A1 * | 1/2004 | Romani | F01D 5/046 415/143 |
| 2015/0000268 | A1 | 1/2015 | Clancy et al. | |
| 2015/0044026 | A1 | 2/2015 | Kilkenny | |
| 2015/0044027 | A1 | 2/2015 | Van Dam et al. | |

OTHER PUBLICATIONS

Danish et al.; Performance Evaluation and Tandem Bladed Centrifugal Compressor; Engineering Applications of Computational Fluid Mechanics; 2014; vol. 8, Issue 3, pp. 382-395.

* cited by examiner

CENTRIFUGAL COMPRESSOR AND SYSTEM

FIELD

The subject matter described herein relates to centrifugal compressors.

BACKGROUND

Centrifugal compressors are used in various industries to pressurize a fluid (e.g., gas and/or liquid). For example, centrifugal compressors may be used in gas turbines, engines (e.g., turbochargers), natural gas pipelines, oil refineries, chemical processing applications, and other industry-specific applications. A centrifugal compressor includes an impeller that rotates about an axis. Blades are distributed circumferentially around the rotating axis. The blades are shaped such that the incoming fluid exits the impeller in a radial direction into a diffuser of the centrifugal compressor. The impeller imparts energy to the fluid as the fluid flows therethrough. The centrifugal compressor is typically configured to increase the pressure of the incoming fluid by a factor of at least 1.2 and often greater, such as up to 13.0 or more. A centrifugal compressor may be characterized by its operating range, which may be based on the difference between the mass flow at the choke point (or an upper limit on the mass flow) and the mass flow at the stall point (or a lower limit on the mass flow).

For many applications, it is generally desirable to increase the operating range of the centrifugal compressor. For example, high flow coefficient and high pressure ratio compressors may have relatively narrow operating ranges and may experience blockages along the shroud of the compressor as the operating point moves towards lower mass flows. Various designs have been proposed for increasing the operating range. For example, a tandem inducer may be added to the impeller to reduce shock losses. Tandem inducers typically include discrete inducer blades that are positioned upstream from corresponding main blades of the impeller such that a gap exists between a trailing edge of the inducer blade and a leading edge of a respective main blade. Although tandem inducers have been studied in the past as a possible modification for improving the performance of a centrifugal compressor, commercially-viable designs that improve flow conditions when the impeller is operating at lower mass flows have heretofore not been provided.

BRIEF DESCRIPTION

In an embodiment, a centrifugal compressor is provided. The centrifugal compressor includes an impeller body configured to rotate around a central axis. The impeller body has an impeller surface that surrounds the central axis. The centrifugal compressor also includes plural flow-control blades coupled to the impeller body and distributed around the central axis. The flow-control blades have pressure sides and opposite suction sides. The flow-control blades include main sections and inducer sections that project away from the impeller surface. The inducer sections are positioned upstream from the main sections of the flow-control blades. The inducer sections include trailing edges and the main sections include leading edges spaced apart from the trailing edges. The inducer sections are aligned with the main sections as the inducer and main sections project from the impeller surface to designated points away from the impeller surface. The inducer sections and the main sections have at least one of different lean angles or different camber line distributions that form bleed gaps between the trailing and leading edges after the designated points. The bleed gaps are shaped to permit fluid to flow therethrough from the pressure sides to the suction sides.

In one aspect, the designated points may occur at 50% flow path spans of the inducer sections or greater (e.g., further away from the impeller surface).

In another aspect, the bleed gaps are configured to improve efficiency of the centrifugal compressor at mass flows below a design point of the centrifugal compressor compared to another centrifugal compressor having inducer and main sections that do not form the bleed gaps.

In another aspect, the trailing edges of the inducer sections have first lean angles toward the suction sides of the flow-control blades as the inducer sections extend further away from the impeller surface and the designated points. The leading edges of the main sections have second lean angles toward the suction sides of the corresponding flow-control blades as the main sections extend further away from the impeller surface and the designated points. The first lean angles are greater than the second lean angles thereby forming the bleed gaps.

Optionally, a difference between the first lean angle and the second lean angle may be at least 0.4° at some point after the designated point. Optionally, a difference between the first lean angle and the second lean angle may not exceed 6.0° after the designated point.

In another aspect, as the inducer and main sections extend further away from the impeller surface and the designated points, the camber line distributions of at least one of the inducer sections or the main sections may change to form the bleed gaps between the trailing and leading edges. For example, the camber line distribution of the inducer section after the designated point may be changed relative to the camber line distribution of the inducer section at or prior to the designated point. The camber line distribution may be changed by changing a path or curvature of the camber line and/or by changing a thickness of the inducer section along the camber line.

In another aspect, the flow-control blades have blade hubs at the impeller surface and extend from the blade hubs to blade tips. The trailing edges of the inducer sections and the leading edges of the main sections may be separated from one another from the impeller surface to the blade tips. The trailing and leading edges may form respective operating gaps therebetween that begin at the impeller surface. The operating gaps may include the bleed gaps.

In another aspect, the inducer sections and the main sections form common bases of the flow-control blades. The common bases may be continuous structures such that the inducer sections and the main sections are devoid of gaps from the impeller surface to the designated points.

In another aspect, the centrifugal compressor also includes a plurality of splitter blades that are coupled to and project outward from the impeller surface. The splitter blades are positioned between adjacent main sections of the flow-control blades.

In an embodiment, a system is provided that includes a drive shaft configured to rotate about a central axis and a centrifugal compressor operably coupled to the drive shaft and configured to receive an input fluid flow. The centrifugal compressor includes a compressor housing having a working cavity and an impeller body configured to rotate around the central axis. The impeller body has an impeller surface that surrounds the central axis. The centrifugal compressor also includes plural flow-control blades that are coupled to the impeller body and distributed around the central axis. The flow-control blades have pressure sides and opposite suction sides. The flow-control blades include main sections and inducer sections that project away from the impeller surface. The inducer sections are positioned upstream from the main sections of the flow-control blades. The inducer sections include trailing edges and the main sections include leading edges that are spaced apart from the trailing edges. The inducer sections are aligned with the main sections as the inducer and main sections project from the impeller surface to a designated point away from the impeller surface. The inducer sections and the main sections have at least one of different lean angles or different camber line distributions that form bleed gaps between the trailing and leading edges after the designated points. The bleed gaps are shaped to permit fluid to flow therethrough from the pressure sides to the suction sides.

BRIEF DESCRIPTION OF THE DRAWINGS

The inventive subject matter described herein will be better understood from reading the following description of non-limiting embodiments, with reference to the attached drawings, wherein below.

DETAILED DESCRIPTION

Figure 1:
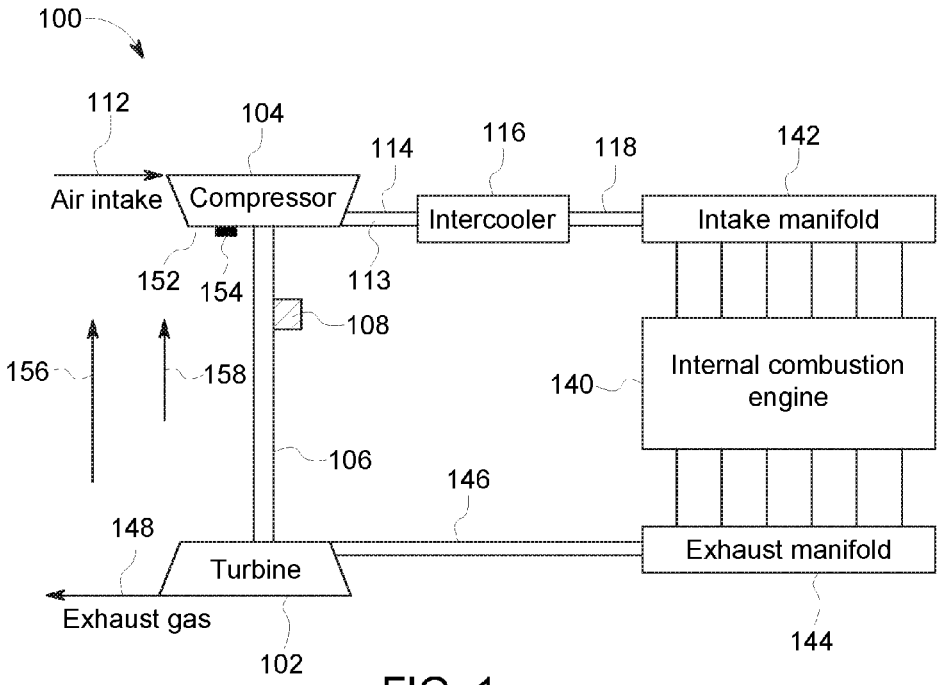
FIG. 1 is a schematic diagram of a system having a centrifugal compressor in accordance with an embodiment.

The following detailed description of certain embodiments will be better understood when read in conjunction with the appended drawings. To the extent that the figures illustrate diagrams of the functional blocks of various embodiments, the functional blocks are not necessarily indicative of the division between hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

FIG. 1 is a schematic view of a powered system 100 formed in accordance with an embodiment. The system 100 may be, for example, a single-stage turbocharger system having a centrifugal compressor 104 as set forth herein. It should be understood, however, that embodiments set forth herein may be suitable for other applications, such as applications in aviation or chemical processing.

The system 100 includes a turbine 102 and a compressor 104 that are coupled to each other via a drive shaft 106. The compressor 104 may be similar or identical to the compressor 200 (FIG. 3) or the various alternative embodiments described herein. The system 100 further includes a thrust bearing 108 which is schematically shown as being attached to the drive shaft 106 for supporting a thrust load 156 applied to the drive shaft 106. In the illustrated embodiment, the thrust load 156 is a net thrust load pointing from a side of the turbine 102 to aside of the compressor 104 and is parallel to the drive shaft 106. The net thrust load 156 includes at least a compressor back-surface thrust load 158 component which is generated due to the leakage air flow at the back surface 152 of the compressor 104. The compressor back-surface thrust load 158 points substantially at the same direction as that of the net thrust load 156.

The system 100 includes an engine 140 (e.g., internal combustion engine). The turbine 102 is placed downstream of an exhaust manifold 144 of the engine 140 for receiving exhaust gas discharged from the exhaust manifold 144 and routed through an exhaust channel 146. The exhaust gas passes through the turbine 102 and drives the turbine 102 to rotate. The turbine 102 then drives the shaft 106 and compressor 104 to rotate. In some embodiments, a portion of the exhaust gas passing through the turbine 102 is discharged directly to the environment. In other embodiments, the exhaust gas passing through the turbine 102 may be re-circulated.

The compressor 104 compresses input air flow 112 and produces output air flow 113 at boosted air pressure. In the illustrated embodiment, the output air flow 113 is routed to an intercooler 116 via a first channel 114. The intercooler 116 functions as a heat exchanger to remove heat from the output air flow 113 as a result of the compression process. The cooled output air flow 113 is routed to an intake manifold 142 via a second channel 118. In other embodiments, the output air flow 113 produced from the compressor 104 may be directly routed to the intake manifold 142 of the engine 140 without intercooling.

Optionally, one or more flow restriction structures 154 maybe provided at the back surface 152 of the compressor 104 functions to reduce the amount of leakage air flow entering at back surface 152 of the compressor 104. In other embodiments, the compressor 104 may be used in a two-stage turbocharger system. The two-stage turbocharger system may be configured for supplying pressurized air to an engine to improve the efficiency of the engine.

Again, FIG. 1 illustrates only one example of a system that may use a centrifugal compressor having flow-control blades as set forth herein. It should be understood that centrifugal compressors having the flow-control blades as described herein may be used in various applications and various compressor designs.

Figure 2:
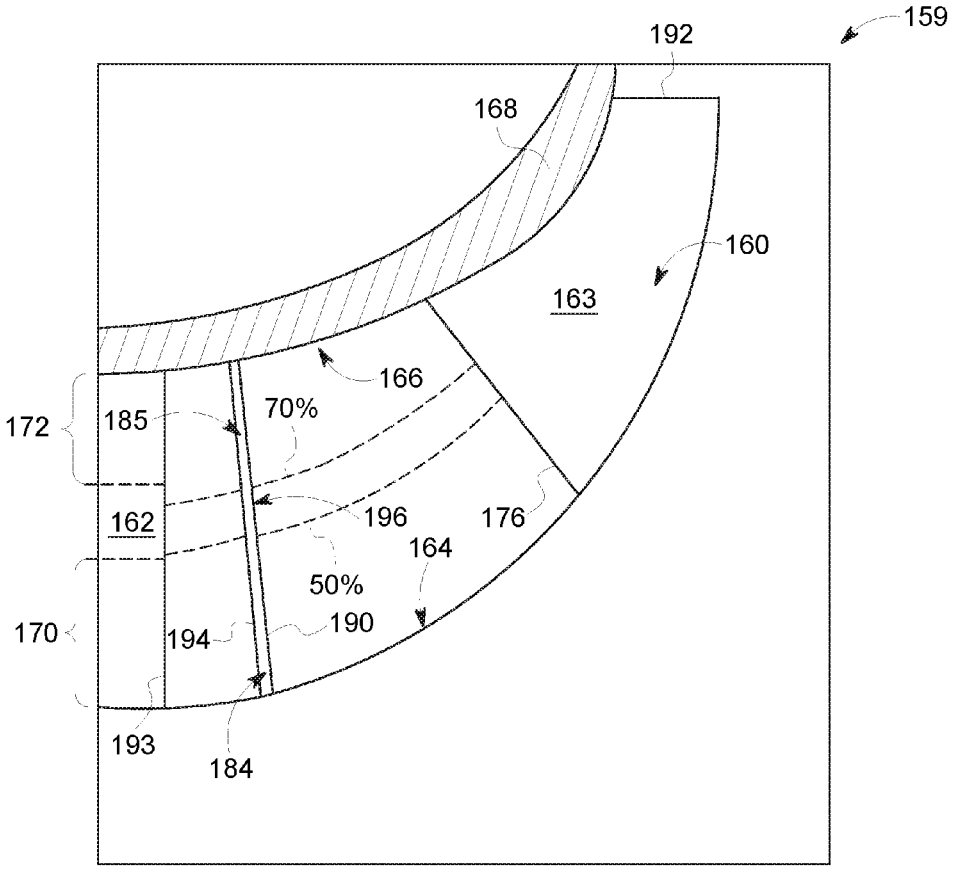
FIG. 2 is a schematic side view of a flow-control blade illustrating different features thereof.

FIG. 2 is a schematic side view of a compressor 159 illustrating a single flow-control blade 160, which may have similar features as the flow-control blades described herein. The flow-control blade 160 is one blade of a plurality of blades that the compressor 158 may have. FIG. 2 also illustrates an annular working cavity 162 that is disposed between an impeller surface 164 and an interior surface 166 of a compressor housing 168, which may also be referred to as a shroud or casing. The flow-control blade 160 is rotated around a central axis (not shown, but see the central axis 204 in FIG. 3 as an example) and moves relative to the compressor housing 168 within the working cavity 162. In other words, the compressor housing 168 does not move with the flow-control blade 160.

Flow passages 163 are defined between adjacent flow-control blades 160. Each flow passage 163 includes an inner region or portion 170 and an outer region or portion 172. The inner region 170 may be a radial space that is adjacent to the impeller surface 164. The inner region 170 is positioned between the impeller surface 164 and the outer region 172. The outer region 172 may be the radial space that is positioned adjacent to the interior surface 166 of the housing 168. The outer region 172 is positioned between the inner region 170 and the interior surface 166.

The flow-control blade 160 has a flow path span that is measured from a hub or root 186 of the flow-control blade 160 to a blade tip 188. The flow path span may be measured by a line 176 that is perpendicular to the impeller surface 164 to the blade tips 188 of the flow-control blades 160. The 70% flow path span and 80% flow path span are shown in FIG. 2. In some embodiments, the inner region 170 may be the space that is below the 50% flow path spans of the flow-control blades 160. In some embodiments, the outer region 172 may be the space that is above the 50% flow path spans of the flow-control blades 160. In certain embodiments, the outer region 172 may be the space that is above the 60% flow path spans or the 70% flow path spans of the flow-control blades 160. As described herein, the flow-control blade 160 is configured to permit air to flow through a bleed gap from one side of the flow-control blade 160 to another side of the flow-control blade in order to improve flow conditions within the outer region 172 of the flow passage 163.

The flow-control blade 160 includes a main section 180 and an inducer section 182 that is positioned upstream from the main section 180. The main section 180 includes a leading edge 190 and a trailing edge 192. The trailing edge 192 may be positioned adjacent to a diffuser (not shown) of the compressor. The inducer section 182 includes a leading edge 193 and a trailing edge 194. The trailing edge 194 is positioned proximate to the leading edge 190 of the main section 180.

The main section 180 and the inducer section 182 are aligned with one another from the impeller surface 164 to a designated point 196 of the flow path span. In the illustrated embodiment, the designated point 196 occurs at about 60% flow path span at the trailing edge. It should be understood, however, that the designated point 196 may occur at a lesser flow path span or greater flow path span. Between the designated point 196 and the blade tip 188, however, the inducer section 182 and the main section 180 may not be effectively aligned such that fluid is permitted to flow between the main section 180 and the inducer section 182. For example, in some embodiments, the main section 180 and the inducer section 182 are joined and form a single unitary structure that has a gap formed at the designated point 196. In other embodiments, the main section 180 and the inducer section 182 are separate blades such that the inducer sections 182 of the flow-control blades 160 effectively form a tandem inducer. In such embodiments, the inducer section 182 may be effectively aligned with the main section 180 to minimize or only permit a nominal or insubstantial amount of fluid to flow therebetween.

In the illustrated embodiment of FIG. 2, the inducer section 182 is separate from the main section 180. The inducer section 182 and the main section 180 may be characterized as being associated with each other (e.g., "the main section and the associated inducer section.") As shown, the inducer section 182 and the main section 180 have an operating gap 184 therebetween. The operating gap 184 exists between the trailing edge 194 and the leading edge 190. The operating gap 184 extends from the impeller surface 164 to the interior surface 166. As described below, a portion of the operating gap 184 forms a bleed gap 185. The outer region 172 is in flow communication with at least a portion of the bleed gap 185. As described herein, the bleed gap 185 is configured to permit fluid to flow between the inducer section 182 and the respective main section 180. As used herein, the term "bleed gap" may be a portion of an operating gap or may form the entire gap between the inducer and main sections. For embodiments in which the bleed gap is a portion of the operating gap, the bleed gap has a greater distance between the trailing and leading edges of the inducer and main sections, respectively, than a previous portion of the operating gap. More specifically, the bleed gap increases in size to allow more airflow.

Figure 3:
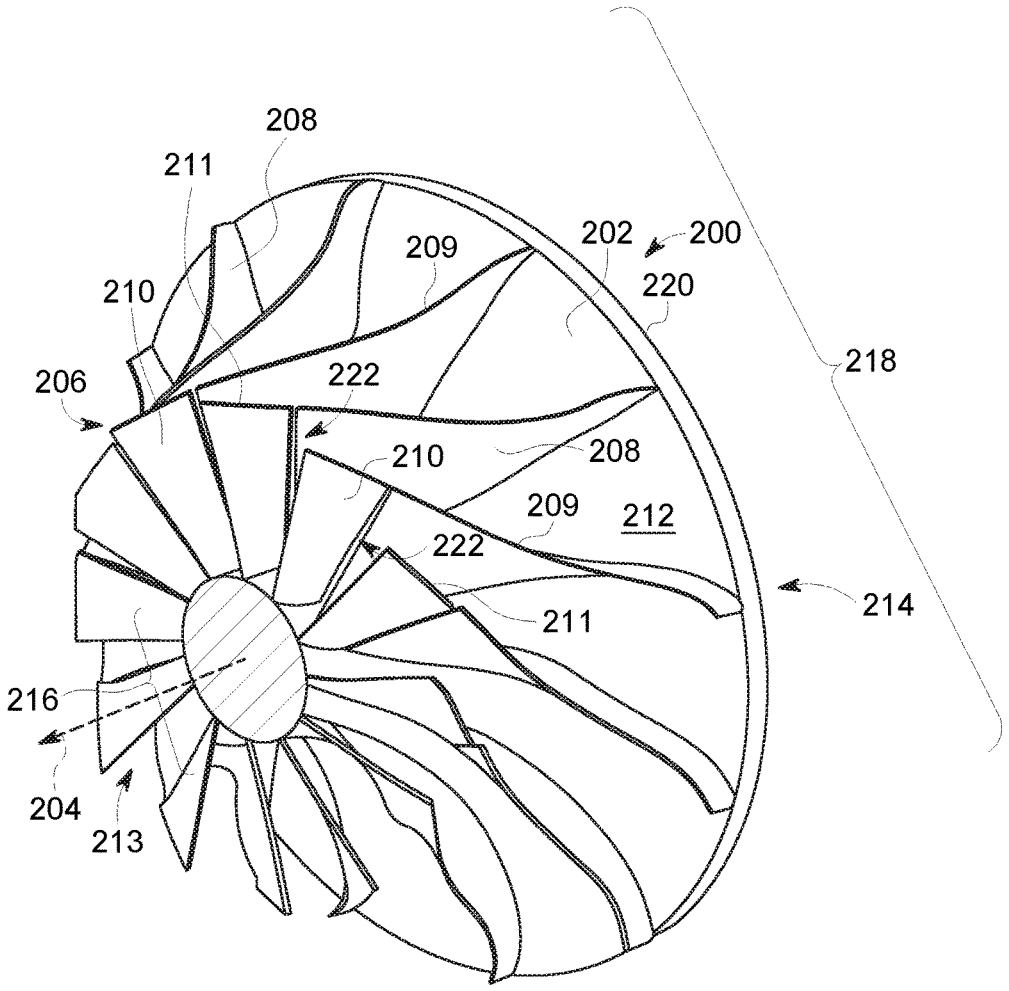
FIG. 3 is a perspective view of a centrifugal compressor that may be used with the system of FIG. 1 and includes a plurality of flow-control blades.

FIG. 3 is a perspective view of the centrifugal compressor 200, which may be used with the system 100 (FIG. 1). The centrifugal compressor 200 includes an impeller or rotor body 202 that is configured to rotate about a central axis (or rotating axis) 204. The centrifugal compressor 200 also includes a plurality of flow-control blades 206 that are distributed about the central axis 204. The flow-control blades 206 may have features that are similar to the flow-control blades 160 (FIG. 2). For example, the flow-control blades 206 include main sections 208 and inducer sections 210. Each of the inducer sections 210 is configured to be positioned relative to a respective (or associated) main section 208 for affecting the airflow as described herein. In the illustrated embodiment, the main sections 208 and the inducer sections 210 are discrete blades that are spaced apart from each other. In other embodiments, however, the main section 208 and the inducer section 210 may be different portions of the same structure. As used herein, the terms "inducer section" and "main section" include the possibility of the inducer section and the main section, respectively, being different portions of a single blade or being discrete blades.

In the illustrated embodiment, the centrifugal compressor 200 is devoid of splitter blades or vanes. In other embodiments, however, the centrifugal compressor 200 may include splitter blades that are positioned between adjacent main sections 208. For example, two main sections 208 may have a single splitter blade positioned therebetween.

The impeller body 202 has a leading end or face 212 and a trailing or rear side 214. The leading end 213 is configured to receive incoming fluid (e.g., gas, liquid, or gas-liquid mixture). The centrifugal compressor 200 is configured to impart energy into the fluid such that the liquid exits the impeller body 202 in a flow direction that is generally perpendicular to the central axis 204.

The impeller body 202 has an external impeller surface 212 that surrounds the central axis 204. The impeller body 202 has a tip or front diameter 216 and a rear diameter 218. The rear diameter 218 may be significantly larger than the front diameter (e.g., 2×, 3×, 4×, or more). The impeller surface 212 extends away from the tip (not shown) of the impeller body 202 in a direction that is initially along the central axis 204 and then curves away from the central axis 204 to an outer edge 220 of the impeller body 202.

The main sections 208 and the inducer sections 210 are coupled to and project outward from the impeller surface 212 toward respective blade tips 209, 211. The blade tips 209, 211 are located away from the impeller surface 212 and may be referred to as shroud edges. The blade tips 209, 211 extend generally along an interior surface of a housing or shroud (not shown) that encloses the impeller body 202. For example, the compressor housing may be similar to the compressor housing 168 (FIG. 2). As shown, the inducer sections 210 are positioned upstream from the respective main sections 208. In the illustrated embodiment, an operating gap 222 separates the inducer section 210 from the respective main section 208.

Figure 4:
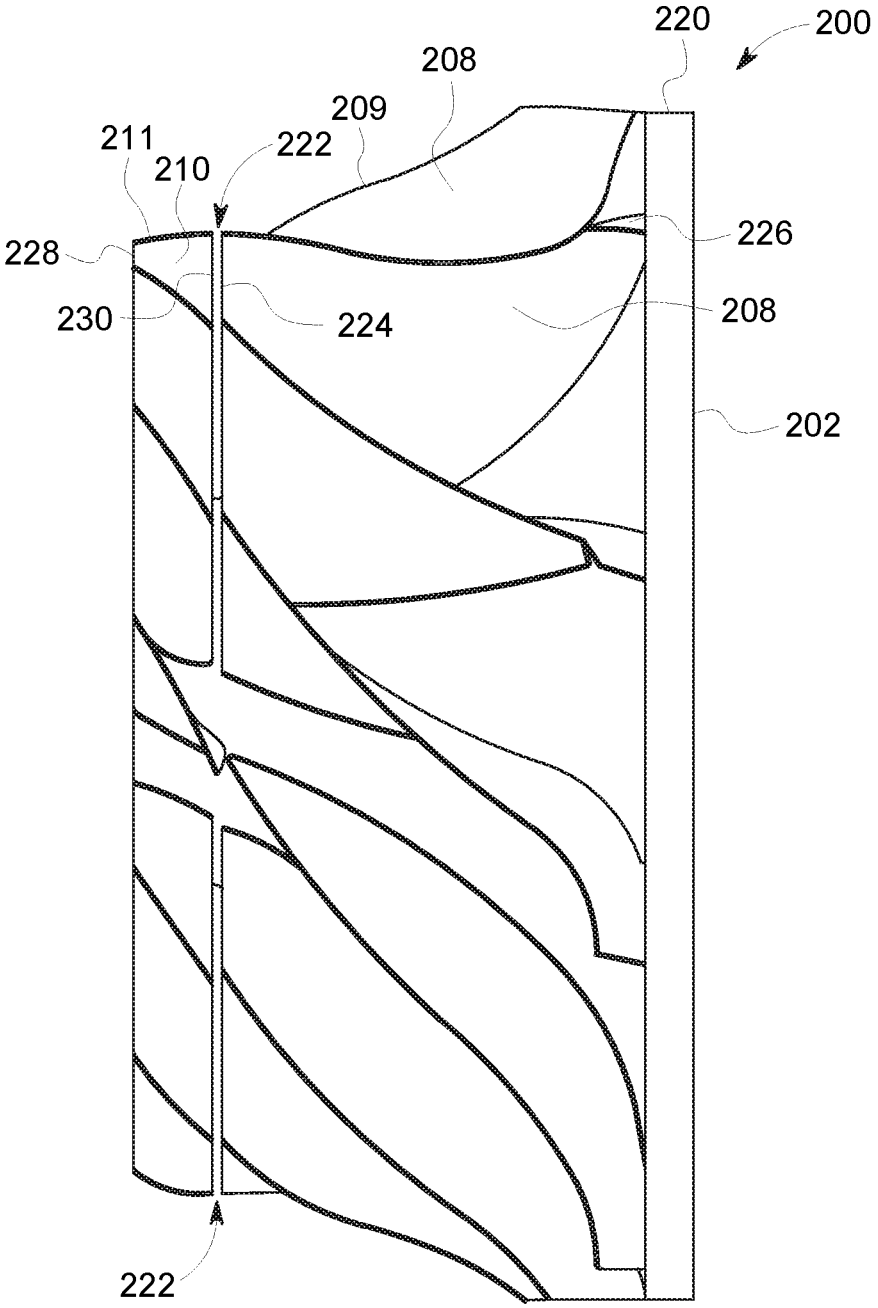
FIG. 4 is a side view of the centrifugal compressor of FIG. 3 illustrating gaps within the flow-control blades.

FIG. 4 is a side view of the centrifugal compressor 200 illustrating the operating gaps 222 of the flow-control blades 206. Each of the main sections 208 includes a leading edge 224, which may also be referred to as the leading main edge or the first leading edge. The main sections 208 extend from the corresponding leading edges 224 to corresponding trailing edges 226. The trailing edge 226 are located proximate to the outer edge 220 of the impeller body 202. Although FIGS. 3 and 4 show the centrifugal compressor 200 having main sections 208 with particular shapes, it should be understood that the main sections in alternative embodiments may have other shapes.

Each of the inducer sections 210 includes a leading edge 228, which may also be referred to as the leading inducer edge or the second leading edge. The inducer sections 210 may also include respective trailing edges 230. As shown, the trailing edge 230 of the inducer section 210 is spaced apart from the respective main section 208 by the operating gap 222. In some embodiments, the operating gap 222 extends from the impeller surface 212 to the blade tips 209, 211 such that the inducer section 210 and the respective main section 208 are discrete (or entirely separate) blades that are coupled to a common impeller surface 212. As described herein, however, the inducer section 210 and the respective main section 208 may be sections of a common flow-control blade such that the operating gap 222 is a notch of slit that only extends partially toward the impeller surface 212. After a designated point 240 (shown in FIG. 8), the operating gap 222 changes to allow fluid to flow between the trailing edge 230 and the leading edge 224 through the operating gap 222. For example, the inducer sections 210 may have lean angles that differ from the lean angles of the respective main sections 208 after the designated point 240 and/or may have a shape that effectively changes the operating gap 222 after the designated point 240.

Figure 5A:
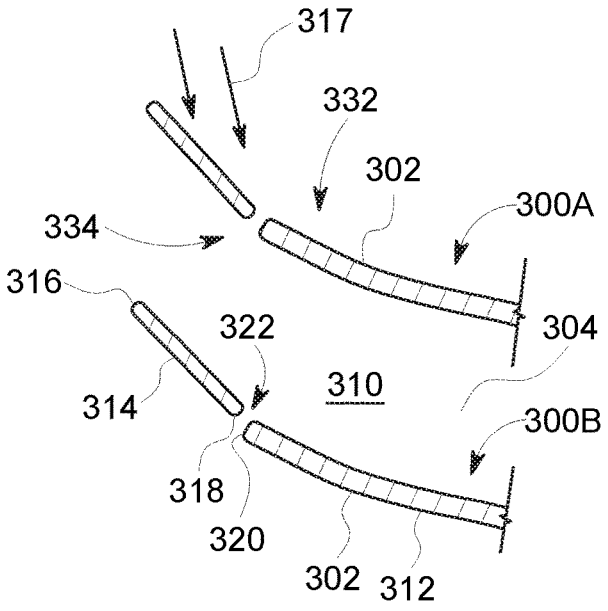
FIG. 5A illustrates cross-sections of a plurality of flow-control blades at about 0% flow path span of the flow-control blades.

FIG. 5A illustrates cross-sections of a plurality of the flow-control blades 300A, 300B. The cross-sections are taken at a blade hub 302 of the corresponding flow-control blade that is immediately adjacent to an impeller surface 304. In other words, the cross-sections are taken proximate to 0% flow path span. As such, space between the flow-control blades 300A, 300B is a part of an inner region 310 of a common flow passage 340. Each of the flow-control blades 300A, 300B includes a main section 312 and an inducer section 314 that is aligned with the respective main section 312. As shown, the inducer section 314 includes a leading edge 316 and a trailing edge 318. The main section 312 includes a leading edge 320 and a trailing edge (not shown). The leading edge 320 of the main section 312 and the trailing edge 318 of the inducer section 314 form an operating gap 322 therebetween.

Each of the flow-control blades 300A, 300B includes a pressure side 332 and a suction side 334. Fluid flow 317 is incident on the pressure side 332. In some embodiments, the leading edge 320 of the main section 312 and the trailing edge 318 of the inducer section 314 are positioned with respect to each other such that fluid flow through the operating gap 322 is minimized or a nominal or insubstantial amount of fluid flow exists therethrough. In other embodiments, a more substantial amount of fluid flow may be permitted through the operating gap 322 to achieve a designated performance. An amount of fluid flow through the operating gap 322 may be determined by testing and/or using modeling software to analyze the performance of the flow-control blades.

Figure 5B:
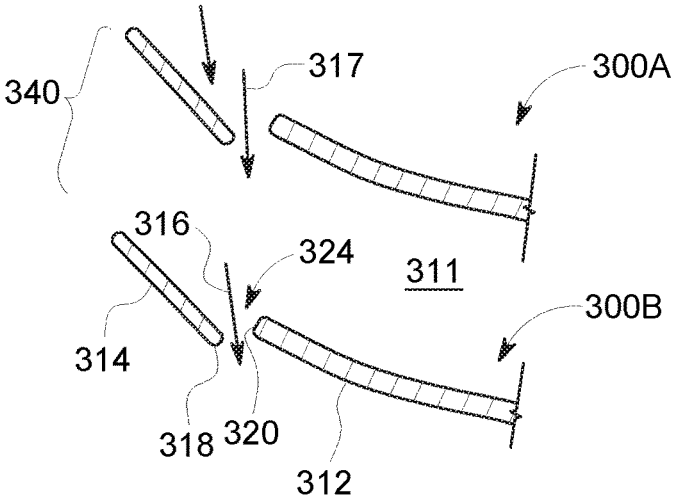
FIG. 5B illustrates cross-sections of the plurality of flow-control blades in FIG. 5A at about 80% flow path span of the flow-control blades.

FIG. 5B illustrates cross-sections of the flow-control blades 300A, 300B at about 80% flow path span. The cross-sections are taken after a designated point (not shown) at which the trailing edge 318 deviates or diverges from the leading edge 320 to form a bleed gap 324 therebetween. In FIG. 5B, the bleed gap 324 has a larger size than the operating gap 322 in FIG. 5A. Moreover, the trailing edge 318 is moved with the direction of fluid flow. As such, the bleed gap 324 may permit more fluid flow therethrough compared to fluid flow through the operating gap 322 at a shorter flow path span. In some embodiments, the increased fluid flow may reduce shock losses that occur within an outer region 311. The inner region 310 (FIG. 5A) and the outer region 311 are portions of a common flow passage 340 that is defined between the suction side 334 of the flow-control blade 300A and the pressure side 332 of the flow-control blade 300B.

The operating gap 322 may be enlarged to form the bleed gap 324 in various manners. For example, in an exemplary embodiment, the inducer section 314 may be shaped to have a different lean angle relative to the lean angle of the main section 312 and/or relative to the lean angle of the inducer section 314 prior to the designated point (not shown). In particular embodiments, the lean angle may be increased in the direction of fluid flow or toward the suction side. In some embodiments, the increased lean angle may be toward the interior surface of the compressor housing (not shown). As such, the bleed gap 324 permits more fluid flow through the operating gap 322 from the pressure side 332 to the suction side 334.

Figure 6A:
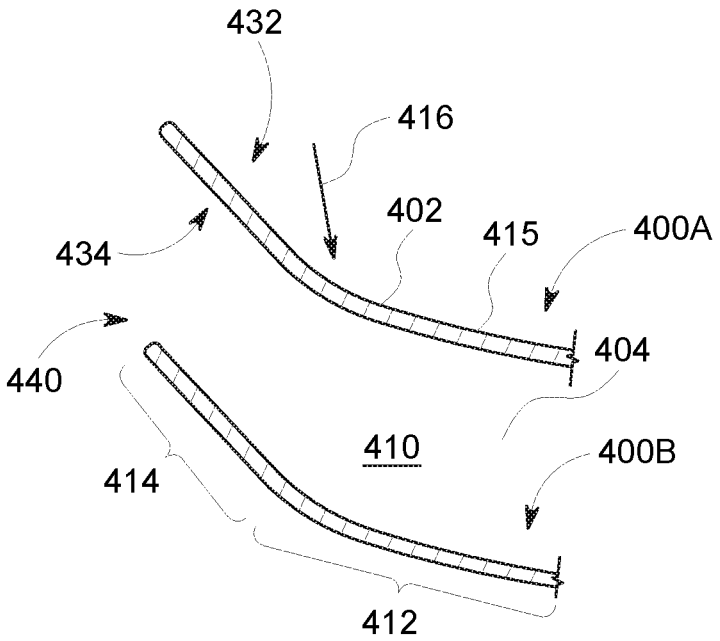
FIG. 6A illustrates cross-sections of a plurality of flow-control blades at about 0% flow path span of the flow-control blades.

FIG. 6A illustrates cross-sections of a plurality of the flow-control blades 400A, 400B. The cross-sections are taken at a blade hub 402 of the corresponding flow-control blade that is immediately adjacent to an impeller surface 404 (or about 0% flow path span). Space between the flow-control blades 400A, 400B is defined as a flow passage 440 and includes an inner region 410. Each of the flow-control blades 400A, 400B includes a main section 412 and an inducer section 414 that is aligned with the respective main section 412. Unlike the flow-control blades 300A, 300B, each of the inducer sections 414 and the respective main section 412 forms a common base 415 of the corresponding flow-control blade. The common base 415 is a continuous structure such that the inducer sections 414 and the respective main sections 412 are devoid of gaps from the impeller surface 404 to a designated point (not shown). After the designated point, a gap (e.g., bleed gap) may be formed. As used herein, the term "after the designated point" means the portions between the designated point and the blade tips.

Each of the flow-control blades 400A, 400B includes a pressure side 432 and a suction side 434. The flow passage 440 is defined between the suction side 434 of the flow-control blade 300A and the pressure side 432 of the flow-control blade 300B. Fluid flow 416 is incident on the pressure side 432. Because the common base 415 is a continuous structure, fluid flow between from the pressure side 432 to the suction side 434 is not possible.

Figure 6B:
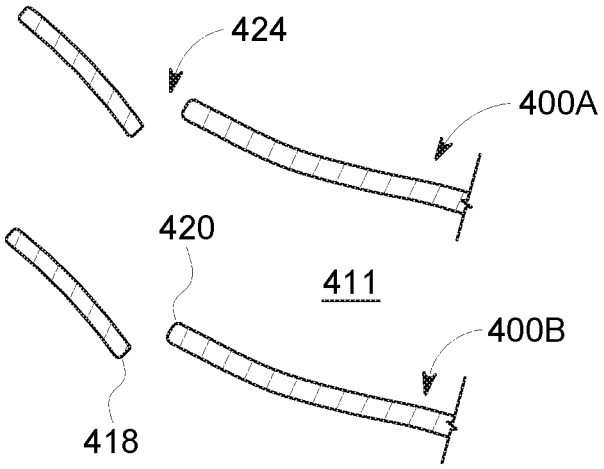
FIG. 6B illustrates cross-sections of the plurality of flow-control blades in FIG. 6A at about 80% flow path span of the flow-control blades.

FIG. 6B illustrates cross-sections of the flow-control blades 400A, 400B at about 80% flow path span. As shown, the inducer sections 414 have a trailing edge 418 and the main sections 412 have a leading edge 420. The cross-sections in FIG. 6B are taken after a designated point (not shown) at which the trailing edge 418 deviates or diverges from the leading edge 420 to form a bleed gap 424 therebetween. Similar to the bleed gap 324 (FIG. 6B), the bleed gap 424 may permit fluid flow therethrough whereas fluid flow is not permitted below the designated point. In some embodiments, the fluid flow may reduce shock losses that occur within an outer region 411. The inner region 410 (FIG. 6A) and the outer region 411 are portions of the flow passage 440.

The operating gap 422 may be enlarged to form the bleed gap 424 in various manners. For example, in an exemplary embodiment, the inducer section 414 may be shaped to have a different lean angle relative to the lean angle of the main section 412 and/or relative to the lean angle of the inducer section 414 prior to the designated point (not shown). In particular embodiments, the lean may be increased in the direction of fluid flow. In some embodiments, the increased lean may be toward the interior surface of the compressor housing (not shown). As such, the bleed gap 424 permits fluid flow through the operating gap 422 from the pressure side 432 to the suction side 434.

The flow-control blades 300A, 300B and the flow-control blades 400A, 400B form the respective bleed gaps by modifying the lean angles of the respective inducer sections. The embodiment of FIGS. 7A and 7B, however, form a bleed gap by modifying the shape of the cross-section relative to the cross-section below the designated point.

Figure 7A:
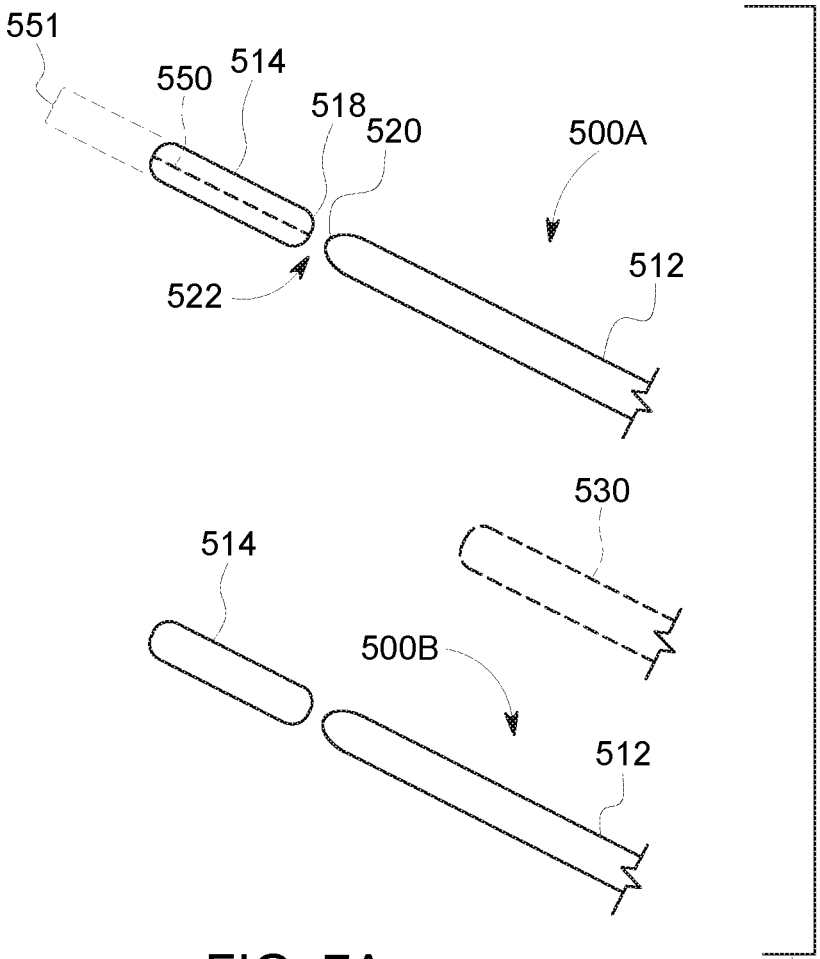
FIG. 7A illustrates cross-sections of a plurality of flow-control blades at about 0% flow path span of the flow-control blades.
Figure 7B:
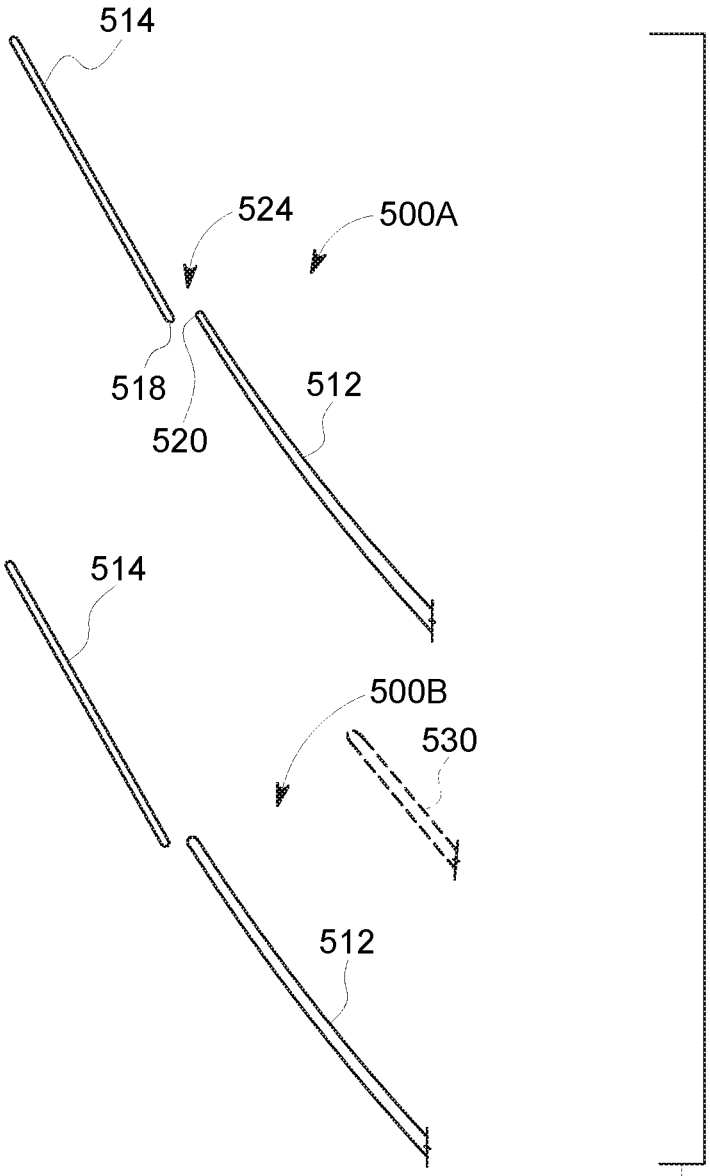
FIG. 7B illustrates cross-sections of the plurality of flow-control blades in FIG. 7A at about 80% flow path span of the flow-control blades.

FIG. 7A illustrates cross-sections of a plurality of flow-control blades 500A, 500B at about 0% flow path span, and FIG. 7B illustrates cross-sections of the plurality of flow-control blades 500A, 500B at about 80% flow path span. For illustrative purposes, the cross-hatching is not shown. In some embodiments, a camber line distribution (or cross-sectional profile) of the flow-control blades may be modified to form a bleed gap between a trailing edge of an inducer section and a leading edge of a corresponding main section. A camber line is a line that extends between a leading edge and a trailing edge of a blade and halfway between the opposite surfaces (e.g., pressure side and suction side) of the blade. Blades with different thicknesses may, nonetheless, have the same camber lines. A camber line distribution is a function of the camber line and a thickness of the blade along the camber line. Embodiments set forth herein may have camber line distributions that are configured to enlarge a gap between the inducer section and corresponding main section and thereby form the bleed gap. For example, the camber line distribution of the inducer section after the designated point may be changed relative to the camber line distribution of the inducer section at or prior to the designated point. The camber line distribution may be changed by changing a path or curvature of the camber line and/or by changing a thickness of the inducer section along the camber line.

It is noted that such embodiments may have discrete (e.g., entirely separate) inducer sections and main sections or may have inducer and main sections that share a common base as described with respect to FIG. 6A. FIGS. 7A, 7B illustrate inducer sections and main sections that are entirely separate from the impeller surface to the corresponding blade tips. It is also noted that the embodiments of FIGS. 7A, 7B may have inducer sections and main sections with identical lean angles.

Each of the flow-control blades 500A, 500B includes a main section 512 and an upstream inducer section 514. The inducer section 514 includes a trailing edge 518, and the main section 512 includes a leading edge 520. The trailing and leading edges 518, 520 are separated by an operating gap 522. At 0% flow path span, the operating gap 522 is configured to minimize or only permit a nominal or insubstantial amount of fluid flow therethrough. This configuration may exist until a designated point (not shown). The designated point may occur at, for example, 70% flow path span. The operating gap 522 may enlarge to form a bleed gap 524 (FIG. 7B) after the designated point.

In the illustrated embodiment, the bleed gap 524 is formed by modifying a camber line distribution of the flow-control blades 500A, 500B. For example, the inducer section 514 has a camber line distribution that is a function of a camber line 550 of the inducer section 514 (shown in FIG. 7A) and a thickness 551 (shown in FIG. 7A) of the inducer section 514. As can be seen by comparing FIGS. 7A and 7B, the camber line distributions of the inducer section 514 and/or the main section 512 have changed. Due to the change, the operating gap 522 is enlarged thereby forming the bleed gap 524. The bleed gap 524 may be configured to allow a designated amount of fluid flow. The amount of fluid flow may be configured to reduce shock losses or otherwise improve flow conditions within a flow passage 540.

It is understood that the camber line may be modified in other manners to allow greater fluid flow between the trailing and leading edges. For example, the camber line may have a length that is decreased in a manner that enlarges the operating gap to form the bleed gap. Alternatively or in addition to changing dimensions of the camber line, the camber line distribution may be changed by changing a thickness of the corresponding flow-control blade (or section) along the corresponding camber line. It should also be understood that the camber line distribution of the main section may be changed to form the bleed gap.

Also shown in FIGS. 7A and 7B, embodiments may optionally include splitter blades 530 that are positioned between adjacent main sections 512. The splitter blades may have different positions than the position shown in FIGS. 7A, 7B. The splitter blades may be configured to achieve a designated performance.

Figure 8:
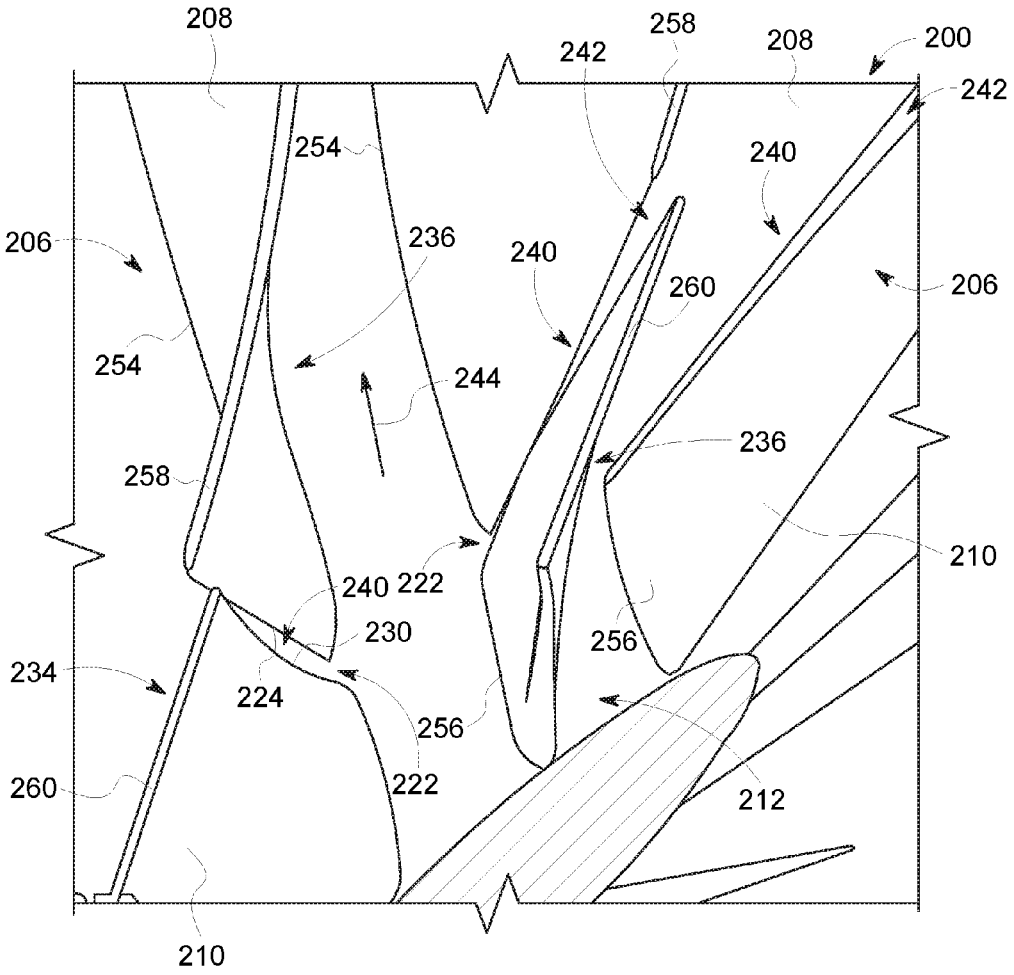
FIG. 8 is an enlarged front perspective view of a portion of the centrifugal compressor of FIG. 3.

FIG. 8 is an enlarged front perspective view of a portion of the centrifugal compressor 200. As shown, the flow-control blades 206 are coupled to and distributed about the impeller surface 212 such that the flow-control blades 206 surround the central axis 204 (FIG. 3). Each of the flow-control blades 206 has a pressure side 234 and an opposite suction side 236. The main sections 208 and the respective inducer sections 210 project away from the impeller surface 212. The inducer sections 210 are positioned upstream from the respective main sections 208. The trailing edge 230 of the inducer section 210 and the leading edge 224 of the main section 208 are spaced apart from each other.

As shown, the inducer sections 210 are aligned with the respective main sections 208 as the inducer and main sections 210, 208 project from the impeller surface 212 to a designated point 240 away from the impeller surface 212. In the illustrated embodiment, the designated point 240 occurs at 70% flow path span of the inducer section 210 at the trailing edge. However, the designated point 240 may occur at 40% flow path span or greater in other embodiments, such as 50% flow path span, 60% flow path span, 70% flow path span, or 80% flow path span. Bleed gap portions 242 of the operating gaps 222 begin after the respective designated points 240 and are configured to permit fluid to flow therethrough from the pressure side 234 to the suction side 236.

Flow passages 244 are defined between adjacent flow-control blades 206. More specifically, the flow passages 244 are defined between the suction side 236 of one flow-control blade 206 and the pressure side 234 of the adjacent flow-control blade 206. Each flow passage 244 includes an inner region and an outer region. The bleed gap portions 242 may be configured to permit fluid therethrough from the outer region of one flow passage 244 to the outer region of an adjacent flow passage 244.

As shown in FIG. 8, each of the inducer sections 210 has a lean angle, and each of the main sections 208 has a lean angle that is essentially equal to the lean angle of the inducer section 210 such that the inducer sections 210 and the main sections 208 are aligned with each other. As the inducer and main sections 210, 208 extend further away from the designated point 240 and the impeller surface 212, however, the lean angles of the inducer sections 210 and the respective main sections 208 may change relative to each other to form the bleed gap portions 242. For example, the lean angles of the inducer sections 210 may be greater than the lean angles of the main sections 208 such that the inducer sections 210 lean more toward the suction side 236 than the respective main sections 208 thereby changing (e.g., enlarging) the operating gap 222 to form the bleed gap portions 242.

In some embodiments, a difference between the lean angle of the trailing edge of the inducer section 210 and the lean angle of the main section 208 at the same percent flow path span (e.g., 80% flow path span) is at least 0.4°. The lean angle of the inducer section 210 may be determined at the trailing edge 230, and the lean angle at the main section 208 may be determined at the leading edge 224. In certain embodiments, the difference between the lean angle of the inducer section 210 and the lean angle of the main section 208 is at least 0.5°, at least 1.0°, or at least 1.5°. In more particular embodiments, the difference between the lean angle of the inducer section 210 and the lean angle of the main section 208 is at least 2.0°, at least 2.5°, or at least 3.0°. In some embodiments, the difference between the lean angle of the inducer section 210 and the lean angle of the main section 208 does not exceed 10.0°. In certain embodiments, the difference between the lean angle of the inducer section 210 and the lean angle of the main section 208 does not exceed 8.0° or does not exceed 7.0°. In more particular embodiments, the difference between the lean angle of the inducer section 210 and the lean angle of the main section 208 does not exceed 6.0° or does not exceed 5.0°. Thus, for some embodiments, the lean angle of the inducer section 210 may be greater than the lean angle of the main section 208 by a range of 0.4° to 10.0°. In more particular embodiments, the lean angle of the inducer section 210 may be greater than the lean angle of the main section 208 by a range of 0.5° to 7.0°.

It is noted that the difference in lean angle (also referred to as lean differential) may exist from the designated point 240 to the corresponding blade tips, such as 65% flow path span to 100% flow path span. In other embodiments, however, the difference in the lean angles exists from the designated point to a second designated point at which time the lean angles may be equal or, alternatively, the lean angle of the main section 208 may be greater than the lean angle of the inducer section 210. For example, if the designated point 240 occurs at 70% flow path span, the lean angle of the inducer section 210 may be greater than the lean angle at the main section 208 from 70% flow path span to 90% flow path span (e.g., varying within a range of 0.5° to 7.0°). From 90% flow path span to 100% flow path span, the lean angle of the inducer section 210 may be equal to or less than the lean angle at the main section 208.

Alternatively or in addition to the lean differential described above, the inducer section 210 may have different cross-sectional profiles or camber line distributions that effectively change the operating gap 222. Accordingly, in some embodiments, the bleed gaps or bleed gap portions may be formed by at least one of (a) a difference in lean angle between the inducer and main sections or (b) a changing cross-sectional profile or camber line distribution of the inducer sections.

As shown, the main and inducer sections 208, 210 have corresponding blade hubs 254, 256 at the impeller surface 212. The main and inducer sections 208, 210 extend from the corresponding blade hubs 254, 256 to corresponding blade tips 258, 260. The trailing edges 230 of the inducer sections 210 and the leading edges 224 of the respective main sections 208 are separated from one another from the impeller surface 212 to the blade tips 258, 260. The trailing and leading edges 230, 224 form the respective operating gaps 222 therebetween that begin at the impeller surface 212.

Figure 9:
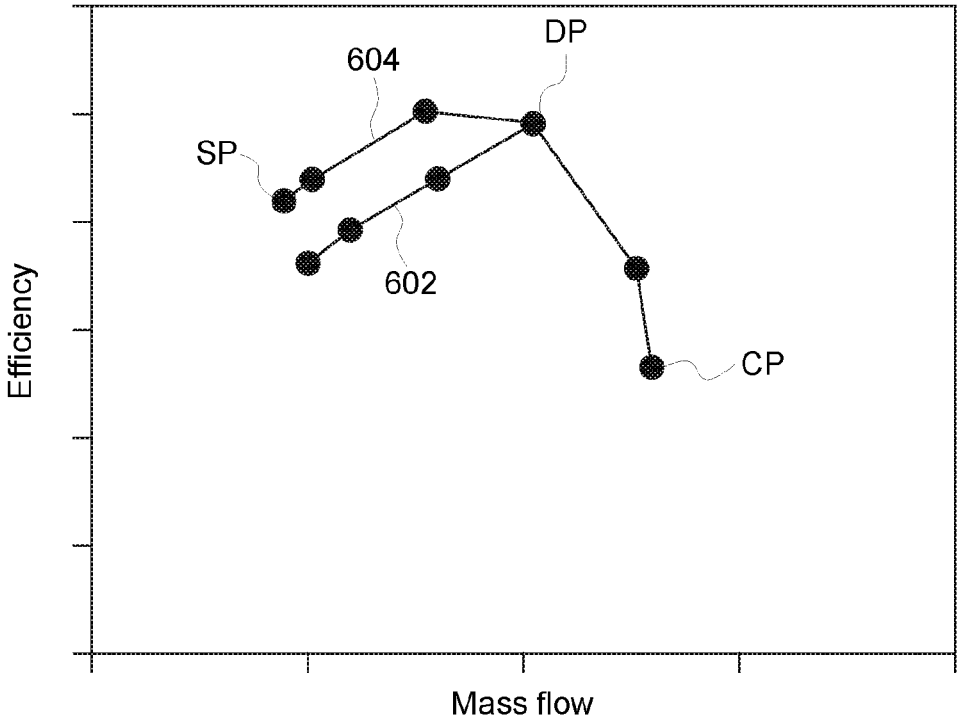
FIG. 9 illustrates a relationship between efficiency and mass flow for one embodiment.

FIG. 9 shows a speed line 602 of a conventional centrifugal compressor, and a speed line 604 of a centrifugal compressor in accordance with an embodiment, such as the embodiment of FIG. 3. The speed lines 602, 604 illustrate a relationship between efficiency and mass flow. The speed line 604 has a design point DP, a choke point CP, and a stall point SP. The speed lines 602, 604 substantially overlap between the choke point CP and the design point DP.

As shown, the efficiency for an embodiment that includes the bleed gaps (or bleed gap portions) described herein is greater than the efficiency for a conventional compressor at lower mass flows (e.g., toward the left operating limit in FIG. 9). Lower mass flows may be those that occur below (to the left of) the design point DP. It is suspected that the conventional compressor has inefficiencies for lower mass flows due to a weak flow region along the suction side of the blades. It is also suspected that the efficiency may be improved by influencing or affecting the tip leakage vortex and/or improving the flow conditions along the suction side of the flow-control blade. As such, compressors operating off-design at lower mass flows may have a greater efficiency. Such embodiments may be suitable for compressors where a high efficiency at lower mass flows is desired. Non-limiting examples of such compressors may include those used in aviation and with turbochargers.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The foregoing description of certain embodiments of the present inventive subject matter will be better understood when read in conjunction with the appended drawings. It is noted that the various embodiments are not necessarily limited to the arrangements and instrumentality shown in the drawings.

What is claimed is:

1. A centrifugal compressor comprising:

an impeller body configured to rotate around a central axis, the impeller body having an impeller surface that surrounds the central axis; and plural flow-control blades coupled to the impeller body and distributed around the central axis, the flow-control blades having pressure sides and opposite suction sides, the flow-control blades including main sections and inducer sections that project away from the impeller surface, the inducer sections positioned upstream from the main sections of the flow-control blades, the inducer sections including trailing edges and the main sections including leading edges spaced apart from the trailing edges;

wherein the inducer sections are aligned with the main sections as the inducer and main sections project from the impeller surface to designated points away from the impeller surface, the inducer sections and the main sections having at least one of different lean angles or different camber line distributions that form bleed gaps between the trailing and leading edges after the designated points, the bleed gaps shaped to permit fluid to flow therethrough from the pressure sides to the suction sides.

2. The centrifugal compressor of claim 1, wherein the designated points occur at 50% flow path spans of the inducer sections or greater.

3. The centrifugal compressor of claim 1, wherein the bleed gaps are configured to improve efficiency of the centrifugal compressor at mass flows below a design point of the centrifugal compressor compared to another centrifugal compressor having inducer and main sections that do not form the bleed gaps.

4. The centrifugal compressor of claim 1, wherein the trailing edges of the inducer sections have first lean angles toward the suction sides of the flow-control blades as the inducer sections extend further away from the impeller surface and the designated points, the leading edges of the main sections having second lean angles toward the suction sides of the corresponding flow-control blades as the main sections extend further away from the impeller surface and the designated points, the first lean angles being greater than the second lean angles thereby forming the bleed gaps.

5. The centrifugal compressor of claim 4, wherein a difference between the first lean angle and the second lean angle is at least 0.4° at some point after the designated point.

6. The centrifugal compressor of claim 5, wherein a difference between the first lean angle and the second lean angle does not exceed 6.0° after the designated point.

7. The centrifugal compressor of claim 1, wherein, as the inducer and main sections extend further away from the impeller surface and the designated points, the camber line distributions of at least one of the inducer sections or the main sections change to form the bleed gaps between the trailing and leading edges.

8. The centrifugal compressor of claim 1, wherein the flow-control blades have blade hubs at the impeller surface and extend from the blade hubs to blade tips, the trailing edges of the inducer sections and the leading edges of the main sections being separated from one another from the impeller surface to the blade tips, the trailing and leading edges forming respective operating gaps therebetween that begin at the impeller surface, the operating gaps including the bleed gaps.

9. The centrifugal compressor of claim 1, wherein the inducer sections and the main sections form common bases of the flow-control blades, the common bases being continuous structures such that the inducer sections and the main sections are devoid of gaps from the impeller surface to the designated points.

10. The centrifugal compressor of claim 1, further comprising a plurality of splitter blades coupled to and projecting outward from the impeller surface, the splitter blades being positioned between adjacent main sections of the flow-control blades.

11. A system comprising:

a drive shaft configured to rotate about a central axis;

a centrifugal compressor operably coupled to the drive shaft and configured to receive an input fluid flow, the centrifugal compressor including:

a compressor housing having a working cavity;

an impeller body configured to rotate around the central axis, the impeller body having an impeller surface that surrounds the central axis; and plural flow-control blades coupled to the impeller body and distributed around the central axis, the flow-control blades having pressure sides and opposite suction sides, the flow-control blades including main sections and inducer sections that project away from the impeller surface, the inducer sections positioned upstream from the main sections of the flow-control blades, the inducer sections including trailing edges and the main sections including leading edges spaced apart from the trailing edges;

wherein the inducer sections are aligned with the main sections as the inducer and main sections project from the impeller surface to a designated point away from the impeller surface, the inducer sections and the main sections having at least one of different lean angles or different camber line distributions that form bleed gaps between the trailing and leading edges after the designated points, the bleed gaps shaped to permit fluid to flow therethrough from the pressure sides to the suction sides.

12. The system of claim 11, wherein the designated points occur at 50% flow path span of the inducer sections or greater.

13. The system of claim 11, wherein the bleed gaps are configured to improve efficiency of the centrifugal compressor at mass flows below a design point of the centrifugal compressor compared to another centrifugal compressor having inducer and main sections that do not form the bleed gaps.

14. The system of claim 11, wherein the trailing edges of the inducer sections have first lean angles toward the suction sides of the flow-control blades as the inducer sections extend further away from the impeller surface and the designated points, the leading edges of the main sections having second lean angles toward the suction sides of the corresponding flow-control blades as the main sections extend further away from the impeller surface and the designated points, the first lean angles being greater than the second lean angles thereby forming the bleed gaps.

15. The system of claim 14, wherein a difference between the first lean angle and the second lean angle is at least 0.4° at some point after the designated point.

16. The system of claim 15, wherein a difference between the first lean angle and the second lean angle does not exceed 6.0° after the designated point.

17. The system of claim 11, wherein, as the inducer and main sections extend further away from the impeller surface and the designated points, the camber line distributions of at least one of the inducer sections or the main sections change to form the bleed gaps between the trailing and leading edges.

18. The system of claim 11, wherein the flow-control blades have blade hubs at the impeller surface and extend from the blade hubs to blade tips, the trailing edges of the inducer sections and the leading edges of the main sections being separated from one another from the impeller surface to the blade tips, the trailing and leading edges forming respective operating gaps therebetween that begin at the impeller surface, the operating gaps including the bleed gaps.

19. The system of claim 11, wherein the inducer sections and the main sections form common bases of the flow-control blades, the common bases being continuous structures such that the inducer sections and the main sections are devoid of gaps from the impeller surface to the designated points.

20. The system of claim 11, further comprising a plurality of splitter blades coupled to and projecting outward from the impeller surface, the splitter blades being positioned between adjacent main sections of the flow-control blades.

* * * * *